US005138803A

United States Patent [19]

Grossen

[11] Patent Number: 5,138,803

[45] Date of Patent: Aug. 18, 1992

[54] DISPLAY PANEL ASSEMBLY

[75] Inventor: John F. Grossen, Magnolia, Ohio

[73] Assignee: Commercial and Architectural Products, Inc., Dover, Ohio

[21] Appl. No.: 640,120

[22] Filed: Jan. 11, 1991

[51] Int. Cl.[5] ..... A47B 57/34

[52] U.S. Cl. ..... 52/36; 211/94; 211/103; 211/190; 211/208; 248/220.3; 248/222.2

[58] Field of Search ..... 211/190, 207, 208, 87, 211/94, 94.5, 103, 193; 248/220.2, 220.3, 222.1, 222.2; 52/27, 36, 38, 239

[56] References Cited

U.S. PATENT DOCUMENTS 4,615,448 10/1986 Johnstonbaugh ..... 211/87
4,629,079 12/1986 Amstutz et al. ..... 211/87
4,944,416 7/1990 Petersen et al. ..... 211/87

FOREIGN PATENT DOCUMENTS 2240992 3/1974 Fed. Rep. of Germany ... 248/222.2

*Primary Examiner*—Michael Safavi
*Attorney, Agent, or Firm*—Pearne, Gordon, McCoy & Granger

[57] ABSTRACT

A display panel assembly having a regular series of undercut slots lined with identical channel inserts that improve the appearance and strength of the panel in the slot areas. The channel insert is capable of being installed in a slot from the face of the panel with a resilient snap fit. This assembly procedure allows the panel to be secured with fasteners in the slots and the fasteners to be concealed by the inserts. Additionally, the inserts can be removed from the slots to allow the fasteners to be exposed and removed for demounting of the panel.

16 Claims, 2 Drawing Sheets

DISPLAY PANEL ASSEMBLY

BACKGROUND OF THE INVENTION

This invention relates to improvements in slotted display panel construction and, in particular, to a novel slot insert for improving the appearance and utility of such panels.

PRIOR ART

U.S. Pat. No. 4,615,448 shows a display panel having horizontal T-shaped slots and a channel-like insert for such slots. The insert of the patented construction improves the aesthetics and performance of the display panel. A problem associated with the type of insert disclosed in this prior art patent is that it must be assembled endwise into the slot from the edge of the panel. For all practical purposes, this requires the inserts to be positioned within the slots before the panels are installed on the wall. When the inserts are preassembled into the slots before the panel is mounted, any screws or like mechanical fasteners used to secure the panel in place are visible, since they cannot be hidden by the insert.

SUMMARY OF THE INVENTION

The invention provides a display panel construction with an insert for an undercut slot that can be readily installed and removed after the panel has been secured in place. In accordance with the invention, the insert has a cross-sectional shape and a composition of resilient material in a combination that allows it to be snapped into a respective slot from the face of the panel. As a result, the panel can be secured to a supporting framework or other underlying base surface with fasteners located in the slots. Thereafter, the insert is assembled into a respective slot by pushing it through the slot opening in the face of the panel. The insert serves its primary function of improving the appearance and utility of the panel and advantageously also serves to conceal any fastening elements in its respective slot. The insert is preferably configured to be resiliently snapped out of a slot so that any fasteners therein can be exposed for easy removal of the panel. The fasteners can be withdrawn to remove the panel without damage, allowing the panel to be installed later, after service work, remodeling, or other operations have been performed. Additionally, the inserts can be removed and replaced with other inserts of different color or texture from time to time to change the appearance of the panel.

In the preferred embodiment, the insert is configured to work with a T-shaped slot. The insert is typically formed as an extrusion, and has an irregular cross section that can be described as L-shaped. The insert configuration conforms to important areas of the T-slot so that it displays a desired shadowed appearance behind the slot opening and affords a pocket to one side of the slot opening to receive a hook of a display bracket. As further described, the insert cross section is arranged so that in its free state it is slightly larger than the entrance of the panel slot, so that when it is snapped into the slot, it is self-retaining. Still further, the insert is shaped so that the free edges of the insert extend slightly beyond the face of the panel and conceal any notches or irregularities which might exist along the edges of the slot.

DESCRIPTION OF THE PREFERRED EMBODIMENT

Figure 1:
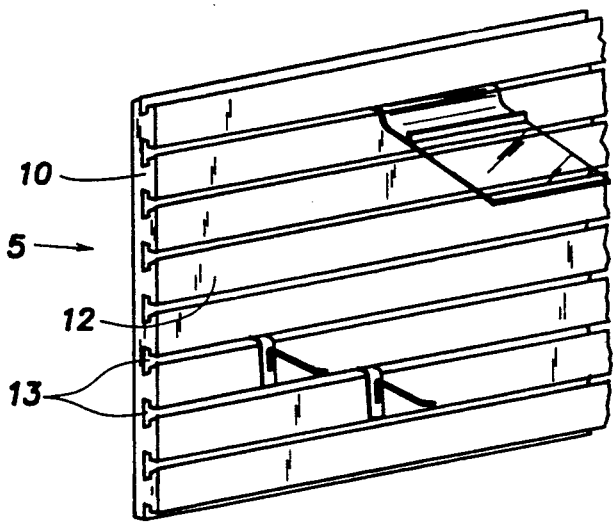
FIG. 1 is a perspective, fragmentary view of a slotted display panel constructed in accordance with the present invention, with hanger brackets installed in the slots.

A display panel assembly 5 includes a panel 10 which is preferably formed of wood composite material such as hardboard fiberboard, flakeboard, chipboard, plywood, or the like, which material is relatively low in cost and relatively strong and stable. A preferred embodiment is formed of an integral layer of medium density fiberboard, a material which is formed by compressing a composition of wood fibers and an adhesive material. The panel 10 may be nominally ¾" thick and provides an exposed face 12 with a surface finish consisting of a paint pattern covered with a protective coating. Since the surface finish is very thin, it is not illustrated in the drawings.

The display panel 10 is generally the same as that described in aforementioned U.S. Pat. No. 4,615,448, and the disclosure of this patent is incorporated herein by reference. The panel 10 is provided with a plurality of equally spaced, parallel, horizontally extending slots 13 having a modified T-shaped, transverse cross section. These slots 13 divide the exposed face into a series of face segments 14.

Figure 3:
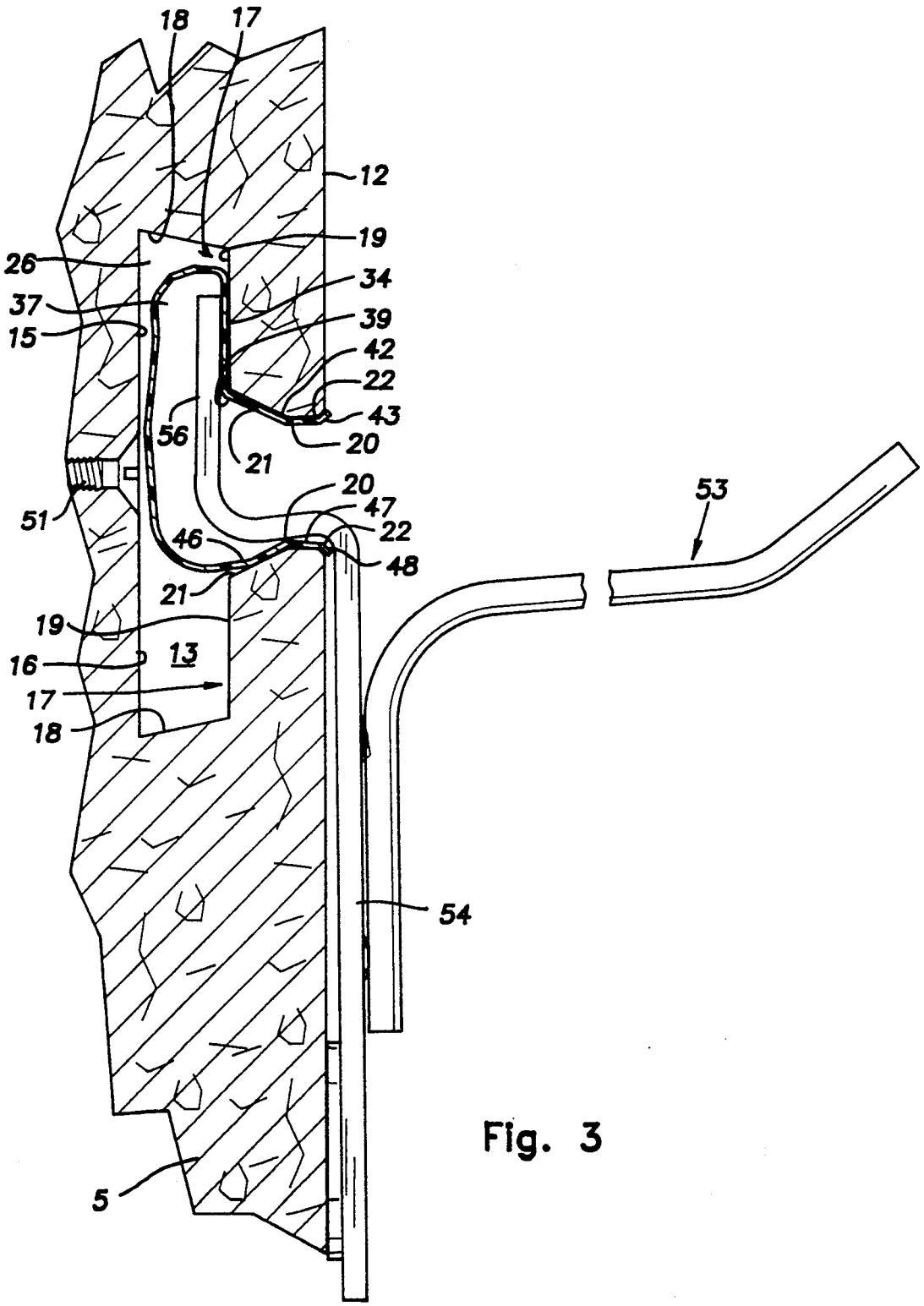
FIG. 3 is an enlarged, cross-sectional, fragmentary view of a slot and channel insert, with a hanger bracket installed.

The slots 13, which are identical, are formed by machining or other suitable process in the face 12 of the panel 10. Ordinarily the panel 10 is mounted in a vertical plane, with the slots running horizontally. With particular reference to FIG. 3, the illustrated slot is of a modified T-shape, being symmetrical about an imaginary horizontal midplane. The slot 13 has a back or base wall surface 16 generally parallel to the face 12 and opposed, stepped side wall surfaces 17. The side wall surfaces 17 include spaced, forwardly converging end areas 18, coplanar return areas 19 generally parallel to the back surface 16, and converging throat areas 21. Chamfer surface areas 22 in the shape of small bevels are provided at the juncture of the slot 13 with the panel face 12. Between the chamfer surfaces 22 and the converging throat areas 21 are opposed and parallel intermediate surfaces 20 which provide the minimum width of the slot openings. The T-shape of the slot 13 affords undercut zones 26 adjacent the upper surface areas 19 to receive and retain display bracket hooks, as described below.

The display panel assembly 5 includes a plurality of channel-like inserts 15 positionable in respective ones of the slots 13. Ordinarily, each slot 13 is provided with an identical channel-shaped insert 15 constructed in accordance with the invention. The insert 15 is typically formed as an extrusion of a plastic, such as polyvinylchloride or styrene. The cross section of the channel insert 15 is L-shaped, and is proportioned to generally complement the contour and embrace the surfaces of the entrance and upper surfaces of an associated slot 13.

Figure 4:
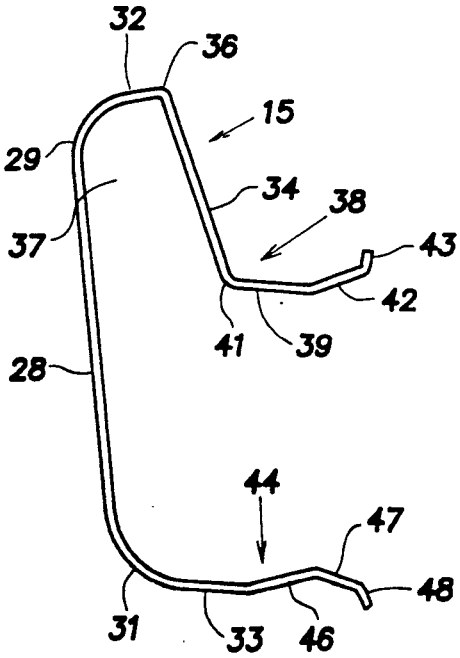
FIG. 4 is an end view of the insert in its free, unstressed condition prior to installation.

The description of the physical shape of the insert defines the structure in terms of upwardly and downwardly extending wall portions as viewed in FIG. 4, which is the normal positioning of the insert with respect to horizontal. However, it should be understood that the use of inner, upper, downward, and forward directions and the like in such description is not intended to be limiting to such positions, and is used for the sake of convenience in understanding the relative directions of the respective component parts of the insert.

Referring to FIG. 4, the insert 15 has an inner wall 28 which extends between radiused portions 29 and 31. Diverging, substantially planar wall portions 32 and 33 respectively extend forwardly from the radiused portions 29 and 31. A downwardly and forwardly extending wall portion 34 joins the wall portion 32 at a relatively sharp corner 36 and cooperates with the inner wall and the wall portions 29 and 32 to define an upwardly extending leg or pocket 37 of the insert.

An upper flange portion 38 extends forwardly from the lower edge of the wall portion 34, and includes a flat wall portion 39 joining the lower edge of the wall portion 34 to relatively sharp corner 41 and a forward portion 42 which diverges upwardly at a slight angle. The free end of the upper flange provides an upstanding lip 43 at the outer edge of the portion 42.

A lower flange 44 extends from the planar wall portion 33. Such flange 44 includes a forwardly extending wall portion 46 which is upwardly inclined from the wall portion 33 to a downwardly inclined wall portion 47. At the free ends of the lower flange is a second lip 48. The upper and lower flanges 38 and 44 cooperate to define an insert throat which extends through the entrance of the slot 13 when the insert is installed. The channel insert 15 in accordance with this invention is characterized by a cross-sectional wall thickness in compositional material, in combination, which produces a resilient snap-in fit into the slot 13 through the openings in the slot at the plane of the exposed panel face 12.

Figure 2:
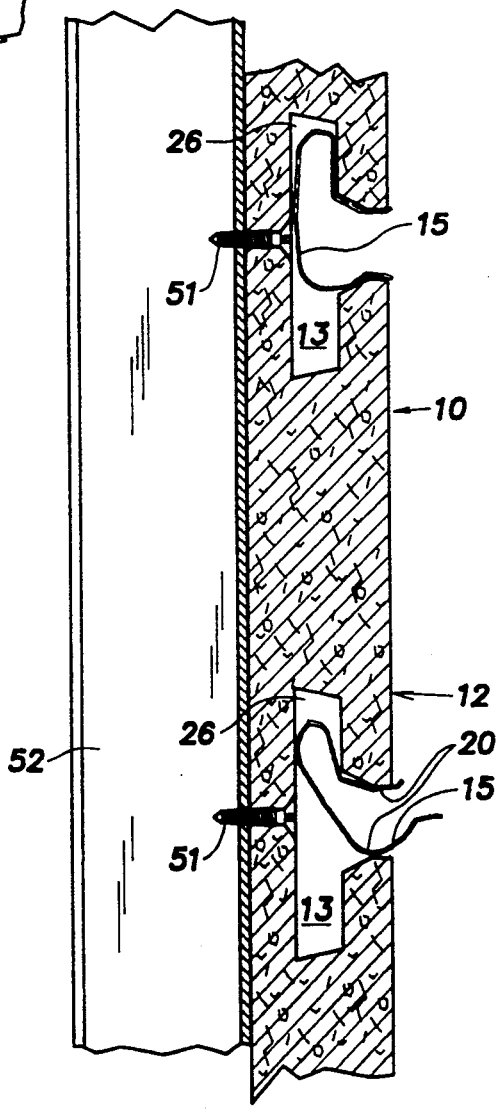
FIG. 2 is an enlarged, fragmentary, cross-sectional view of the display panel assembly mounted on a supporting structure.

The channel insert 15 in the lower portion of FIG. 2 is shown in a partially installed condition. The area of the channel 15 forming the pocket 37 is first inserted through the slot opening at the plane of the exposed face 12 and manipulated into the upper zone 26 of the slot. When the insert 15 is pushed further into the slot 13, flange 44 operates as a cam against the lower intermediate surface 20. This lower flange 28 is thereby caused to be squeezed towards the upper flange 36 and the insert 15 is enabled to be fully received into the slot 13.

In its fully installed state, depicted in the upper portion of FIG. 2 and in FIG. 3, the channel insert is solidly retained in the associated slot 13 by grip of the flanges 38 and 46 on the respective sides of the slot entrance. Specifically, the downwardly extending wall portion 34 fits against the upper planar return area 19. The wall portion 39 extends along the upper converging throat area 21 and the forward portion 42 extends along the upper intermediate surface 20. The lip 43 extends along the upper chamfer surface 22 and extends a slight distance beyond the forward face 12 of the panel. By extending the lip a slight distance beyond the forward face, the lip tends to conceal any imperfections in the panel along the chamfer surface 22.

When installed, the lower flange 44 fits the lower surface of the opening in a similar manner. In such position, the wall portion 46 fits along the lower converging throat area 21, the downwardly inclined wall portion 47 fits along the intermediate surface 20, and the lip 48 fits along the lower chamfer surface 22. Here again, the lip is proportioned to extend slightly beyond the associated chamfer surface 22 to conceal any imperfections in such chamfer surface.

A comparison of FIGS. 3 and 4 demonstrates that the upper and lower flanges 38 and 44, respectively, are deflected from their unstressed condition illustrated in FIG. 4, when the insert is installed as illustrated in FIG. 3. Therefore, the two flange portions snugly and tightly grip the adjacent throat portions of the slot to retain the insert in position. When installed, the inner wall 28 of the insert is bowed and, in fact, is slightly spaced from the back wall or base wall 16 of the slot. In the illustrated embodiment, the inserts are extruded with a wall thickness of about 0.020 inch. With such thin wall, substantial flexibility is provided. Since the throat surfaces of said slot provide rearwardly diverging surface 21 and forwardly diverging surfaces 22 which mate with adjacent surfaces of the flanges 39 and 44, the engagement therebetween locks the insert in its proper installed position.

As best illustrated in FIG. 2, a panel 5 can be installed with screws 51, which are located in the slots and thread into a supporting wall structure 52. After the screws are installed, the inserts 15 are snapped into place and completely conceal the screws from view. Since the inserts can be installed through the front face and need not be inserted lengthwise of the slots, it is possible to first install the wall panel and then install the inserts. Further, if for any reason it is desired to remove the wall, the inserts can be removed from the slots, providing access to the screws 51.

Further, if it is desired to install inserts 15 of a different color to change the contrast with the panel, the installed inserts are removed through the slot throat and the replacement inserts are installed.

FIG. 3 illustrates a typical bracket 53 installed in one of the slots. Such a bracket provides a downwardly extending leg 54 which extends parallel to the forward face 12 of the panel and an inturned hook portion having an upper end 56, which extends up along the upper portion of the slot into the upper leg 37. The horizontal portion 57 rests on the lower flange. When an item to be displayed is positioned on the bracket 53, the vertical force is carried by the lower flange portion 44 and the upper extension or leg 56 prevents the bracket from tipping outwardly. Such brackets are easily installed and removed from any location along the slot.

A desirable shadow effect is exhibited by the channel insert because its flanges 38 and 44 inward of the wall portions 42 and 47 diverge away from one another with reference to a direction looking into the hollow of the insert channel. In this regard, it is to be noted that the cross section of the lower flange 44 does not turn up into a line of sight through the opening 44 of the channel until a point spaced a considerable distance from the plane of the face 12, such distance being, for example, in the order of about one-half the thickness of the panel assembly 5.

It should be evident that this disclosure is by way of example, and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A panel assembly for use in a vertical orientation to suspend the display supports, comprising a panel having a face which is exposed when the panel is installed, a slot extending horizontally along said face providing an interior undercut extending generally parallel to said face and a throat opening defined by opposed throat surfaces and extending between said undercut and said face, and an insert formed of flexible resilient material having a leg extending into said undercut and a pair of opposed flanges extending through said throat and providing an opening communicating with said leg, said flanges being deflected toward each other from their unstressed position by engagement with the adjacent throat surface to resiliently secure said insert in said slot, said flexible material being sufficiently flexible to permit said insert to be installed in an removed from said slot through said throat, said panel being positioned against a supporting wall structure and secured thereto by fasteners installed in said slot, said inserts concealing said fasteners from view through said throat.

2. A panel assembly as set forth in claim 1, wherein said insert is extruded plastic material having a thin wall thickness.

3. A panel assembly as set forth in claim 1, wherein said insert has a wall thickness less than about 0.040 inch.

4. A panel assembly as set forth in claim 1, wherein said panel provides a plurality of spaced and parallel slots with similar inserts installed in each slot.

5. A panel assembly as set forth in claim 1, wherein said flanges extend beyond said throat and conceal the intersection between said throat and said face.

6. A panel assembly as set forth in claim 1, wherein said throat surfaces each provide rearwardly diverging and forwardly diverging portions and said flanges mate with said rearwardly diverging and forwardly diverging surfaces to position said insert in said slot.

7. The panel assembly as set forth in claim 1, wherein said slot includes opposed forward and rearward surface portions defining part of said undercut, said leg of said insert providing opposed forward and rearward wall portions extending vertically in said slots, said forward wall portion of said insert extending along said forward surface portion of said slot in substantial engagement therewith, said rearward wall portion of said insert being spaced from said rearward surface portion of said slot.

8. In combination, a support wall, a panel mounted on said support wall providing an exposed generally vertically extending face, a slot in said panel extending horizontally along said face providing an interior undercut extending generally parallel to said face and a throat opening defined by opposed throat surfaces and extending between said undercut and said face, an insert formed of flexible and resilient material having a leg extending into said undercut and a pair of opposed flanges extending through said throat and providing an opening communicating with said leg, said flanges engaging said opposed throat surfaces to secure said insert in said slot, said flexible material being sufficiently flexible to permit said insert to be installed in and removed from said slot through said throat, fasteners in said slot mounting said panel on said support wall, said insert being installed in said slot after said fasteners are installed to mount said panel on said support wall, said insert concealing said fasteners from view.

9. In the combination as set forth in claim 8, wherein a display bracket is mounted on said panel providing a hooked end which fits into said leg of said insert.

10. The combination as set forth in claim 8, wherein said panel provides a plurality of spaced and parallel slots with similar inserts installed in each slot.

11. A panel assembly for use in a vertical orientation to suspend display supports, the panel having a generally flat face interrupted by a plurality of parallel slots extending lengthwise horizontally across said face, said slots generally being identical and having a regular spacing across the face, each slot having a T-shaped cross section transverse to its length that has depth from the face of the panel and an undercut, each slot having its transverse cross section generally uniform along its length and including an opening adjacent its intersection with the face and a depth measured from the face, the cross section having an undercut so that the width of the slot within the panel is greater than the width of the opening, substantially identical channel inserts received in said slots, each of said channel inserts having a cross section that is proportional to pass through said opening and to resiliently snap into and be self-retaining in its respective slot, each channel insert having a cross section transverse to its length that includes a pocket that is offset and is received in the undercut area of its respective slot.

12. A display panel assembly as set forth in claim 11, wherein the channel insert includes flanges with portions adjacent said face that diverge from one another in a direction inward from said panel face.

13. A display panel assembly as set forth in claim 12, wherein said channel insert flanges have a minimum spacing adjacent said panel face.

14. A display panel assembly as set forth in claim 13, wherein said channel insert flanges from their minimum spacing adjacent said face are spaced from one another a distance greater than said minimum spacing for a depth into said panel that is a substantial fraction of the thickness of said display panel assembly in such a manner that such flanges lie laterally outward of a line of sight through the opening of said channel insert adjacent said face in a direction perpendicular to said face.

15. A display panel assembly as set forth in claim 11, wherein said channel insert includes opposed flanges that have at their respective free edges lips that diverge from one another and that overlie edges of the panel face formed by the intersection of the respective slot with the panel face.

16. A display panel assembly as set forth in claim 11, wherein said channel insert has an L-shaped cross section.

* * * * *